US007224918B2

(12) United States Patent
Bartley et al.

(10) Patent No.: US 7,224,918 B2
(45) Date of Patent: May 29, 2007

(54) METHOD AND APPARATUS FOR CONTROLLING TEMPERATURE OF A LASER PRINTER FUSER WITH FASTER RESPONSE TIME

(75) Inventors: Brian Keith Bartley, Burgin, KY (US); Douglas Campbell Hamilton, Lexington, KY (US); Steven Jeffrey Harris, Lexington, KY (US); Kevin Dean Schoedinger, Lexington, KY (US); Johnny Ray Sears, Midway, KY (US); Jerry Wayne Smith, Irvine, CA (US)

(73) Assignee: Lexmark International, Inc., Lexington, KY (US)

( * ) Notice: Subject to any disclaimer, the term of this patent is extended or adjusted under 35 U.S.C. 154(b) by 250 days.

(21) Appl. No.: 10/967,581

(22) Filed: Oct. 18, 2004

(65) Prior Publication Data

US 2006/0083530 A1 Apr. 20, 2006

(51) Int. Cl.
*G03G 15/20* (2006.01)

(52) U.S. Cl. ..... 399/70

(58) Field of Classification Search ..... 399/67, 399/69, 70, 329; 219/216, 469, 470, 471; 347/156

See application file for complete search history.

(56) References Cited

U.S. PATENT DOCUMENTS

| | | | | |
|---|---|---|---|---|
| 5,768,654 | A * | 6/1998 | Noguchi et al. | 399/69 |
| 6,553,204 | B1 | 4/2003 | Yamada | |
| 6,580,894 | B1 | 6/2003 | Kobashigawa | |
| 6,594,464 | B2 | 7/2003 | Hayashi et al. | |
| 6,597,888 | B1 | 7/2003 | Abe et al. | |
| 6,625,418 | B2 | 9/2003 | Kabai et al. | |
| 6,643,478 | B2 | 11/2003 | Okano | |
| 7,043,185 | B2 * | 5/2006 | Yoshikawa | 399/329 |
| 2003/0190170 | A1 * | 10/2003 | Hamada et al. | 399/69 |
| 2003/0231893 | A1 | 12/2003 | Yoshikawa | |

* cited by examiner

*Primary Examiner*—Hoan Tran
(74) *Attorney, Agent, or Firm*—Frederick H. Gribbell, LLC

(57) ABSTRACT

An improved laser printer is provided that keeps its fuser at a standby temperature that is somewhat raised above the ambient temperature, which allows the printer to operate more quickly (to begin printing the first page) when a print job arrives at the printer. The time needed to raise the fuser's temperature is minimized, so that other printer operations become the determining factor in the time to first print parameter. The electrical energy that energizes the fuser is provided in a form that prevents light flicker, by use of AC waveform phase control, or by use of integer half cycle control. The present invention uses closed-loop feedback control, and the type of controller is a PID controller.

40 Claims, 8 Drawing Sheets

METHOD AND APPARATUS FOR CONTROLLING TEMPERATURE OF A LASER PRINTER FUSER WITH FASTER RESPONSE TIME

TECHNICAL FIELD

The present invention relates generally to image forming equipment and is particularly directed to electrophotographic printers of the type which use heated fusers to fix toner onto print media. The invention is specifically disclosed as a laser printer that runs its belt fuser in a standby mode at a slightly raised temperature to operate more quickly when a print job arrives at the printer. The standby temperature of the fuser is low enough so that the movable components are not required to cycle to otherwise avoid thermal problems, but at the same time the standby temperature is raised to a temperature that allows the printer to begin printing the first page more quickly. If possible, it is preferred for the time required to raise the fuser temperature from the standby temperature to the fusing {or fixing} temperature to be short enough so that other printer operations become the determining factor in the time to first print parameter. (In past printers, the time needed to raise the belt fuser temperature from ambient to operating {or fixing} temperature was the controlling factor.)

The electrical energy to keep the belt fuser at its standby temperature can be provided in a form that prevents light flicker, by use of AC waveform phase control or by use of integer half cycle control, in two exemplary modes of the invention. Such types of control can also be used when heating the belt fuser from its standby to fusing temperatures, especially to prevent large overshoots when approaching the fusing temperature. In one mode of the present invention, the control system uses closed-loop feedback control, and the type of controller is a PID (proportional-integral-derivative controller).

BACKGROUND OF THE INVENTION

Belt fusers are popular for laser printers because of their nearly "instant on" characteristic, i.e., they are heated and prepared to fix toner onto media within a few seconds. The present operation of a conventional belt fuser is to be have the fuser turned off unless toner is being fixed. This mode of operation minimizes the energy used by the printer when it is not printing.

A belt fuser has a finite warm up time that is constrained by the physics (such as thermal capacitance and thermal impedance) of the fuser, the amount of power supplied to the fuser, the desired (target) temperature of the fuser, and the initial conditions of the fuser. Because of improvements in the time at which modern laser printers can generate an image, this finite warm up time has become the limiting factor in time to first print (TTFP). Since there is an interest in improving the time to first print in order to satisfy the user's expectations, a need exists for an improved method. However, any improvement in the time to first print still must meet the important power consumption requirements (such as the USA Environmental Protection Agency ENERGY STAR and German Blue Angel), as well as European flicker and harmonic requirements (IEC 61000-3-2 and 61000-3-3, respectively).

It would be an improvement to minimize the warm-up time of belt fusers in EP printers, while still meeting other important power operating parameters.

SUMMARY OF THE INVENTION

Accordingly, it is an advantage of the present invention to provide an electrophotographic (EP) printer, such as a laser printer, which uses a belt fuser that minimizes the warm-up time required in printing the first sheet of a new print job.

It is another advantage of the present invention to minimize the warm-up time of the belt fuser of an EP printer by applying a small amount of power to the fuser, to keep the fuser at an initial condition between the ambient machine (or room) temperature and the fixing temperature of the fuser of the EP printer.

It is yet another advantage of the present invention to provide an EP printer that minimizes the warm-up time of a belt fuser while also reducing voltage transients that can otherwise result in light flicker that might be created by current supplied to the fuser's heating element.

It is still another advantage of the present invention to reduce the warm-up time of the belt fuser of an EP printer while also reducing voltage and current transients by use of several possible control modes, including integer half-cycle control, or percent duty cycle control using a phase-controlled AC power circuit.

It is a further advantage of the present invention to provide an EP printer that minimizes the warm-up time of a fuser apparatus by use of a PID controller that operates in more than one control mode, including standby, ramping, and printing control modes.

It is yet a further advantage of the present invention to provide an EP printer that minimizes the warm-up time of a fuser apparatus by use of a PID controller that operates in more than one control mode, including standby, ramping, and printing control modes, and in which the PID control parameters exhibit different numeric gain values for some of the different control modes.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a method for controlling a temperature of a printing material fixing apparatus in an image forming apparatus is provided, in which the method comprises the following steps: (a) providing an image forming apparatus having a memory circuit for storage of data, a print engine, and a processing circuit, the print engine including a belt fuser and a heater driver circuit, and the print engine including a supply of printing material to be applied to print media; (b) under the control of the processing circuit, energizing the belt fuser with electrical power from the heater driver circuit in a standby mode, to raise a temperature of the belt fuser to a first temperature that is greater than an ambient temperature of the image forming apparatus; and (c) upon receiving a print job, and under the control of the processing circuit, energizing the belt fuser with electrical power from the heater driver circuit in one of a ramping mode and a printing mode, to quickly raise a temperature of the belt fuser to a second temperature that allows the belt fuser to fix the printer material to the print media, such that a time to first print parameter is reduced as compared to raising the belt fuser temperature from an ambient temperature to the second temperature.

In accordance with another aspect of the present invention, an image forming apparatus is provided, which comprises: a memory circuit for storage of data; a processing circuit; a print engine that produces a physical output upon a print media, the print engine including a belt fuser and a heater driver circuit, and the print engine including a supply of printing material to be applied to the print media; wherein the processing circuit is configured: (a) to energize the belt fuser with electrical power from the heater driver circuit in a standby mode, and thereby raise a temperature of the belt fuser to a first temperature that is greater than an ambient temperature of the image forming apparatus; and (b) upon receiving a print job, to energize the belt fuser with electrical power from the heater driver circuit in one of a ramping mode and a printing mode, and quickly raise a temperature of the belt fuser to a second temperature that allows the belt fuser to fix the printer material to the print media, such that a time to first print operating characteristic is reduced as compared to raising the belt fuser temperature from an ambient temperature to the second temperature.

In accordance with yet another aspect of the present invention, a method for controlling a temperature of a printing material fixing apparatus in an image forming apparatus is provided, in which the method comprises the following steps: (a) providing an image forming apparatus having a memory circuit for storage of data, a print engine, and a processing circuit, the print engine including a heater device and a heater driver circuit, and the print engine including a supply of printing material to be applied to print media; (b) under the control of the processing circuit, energizing the heater device with electrical power from the heater driver circuit in at least one of (i) a standby mode, (ii) a ramping mode, and (iii) a printing mode; (c) the processing circuit being configured to act as a proportional-integral-derivative (PID) controller for energizing the heater device, wherein the PID controller exhibits at least one predetermined PID control parameter when acting in a first of the standby, ramping, and printing modes, and wherein the PID controller varies the at least one of the predetermined PID control parameters when acting in a second of the standby, ramping, and printing modes.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
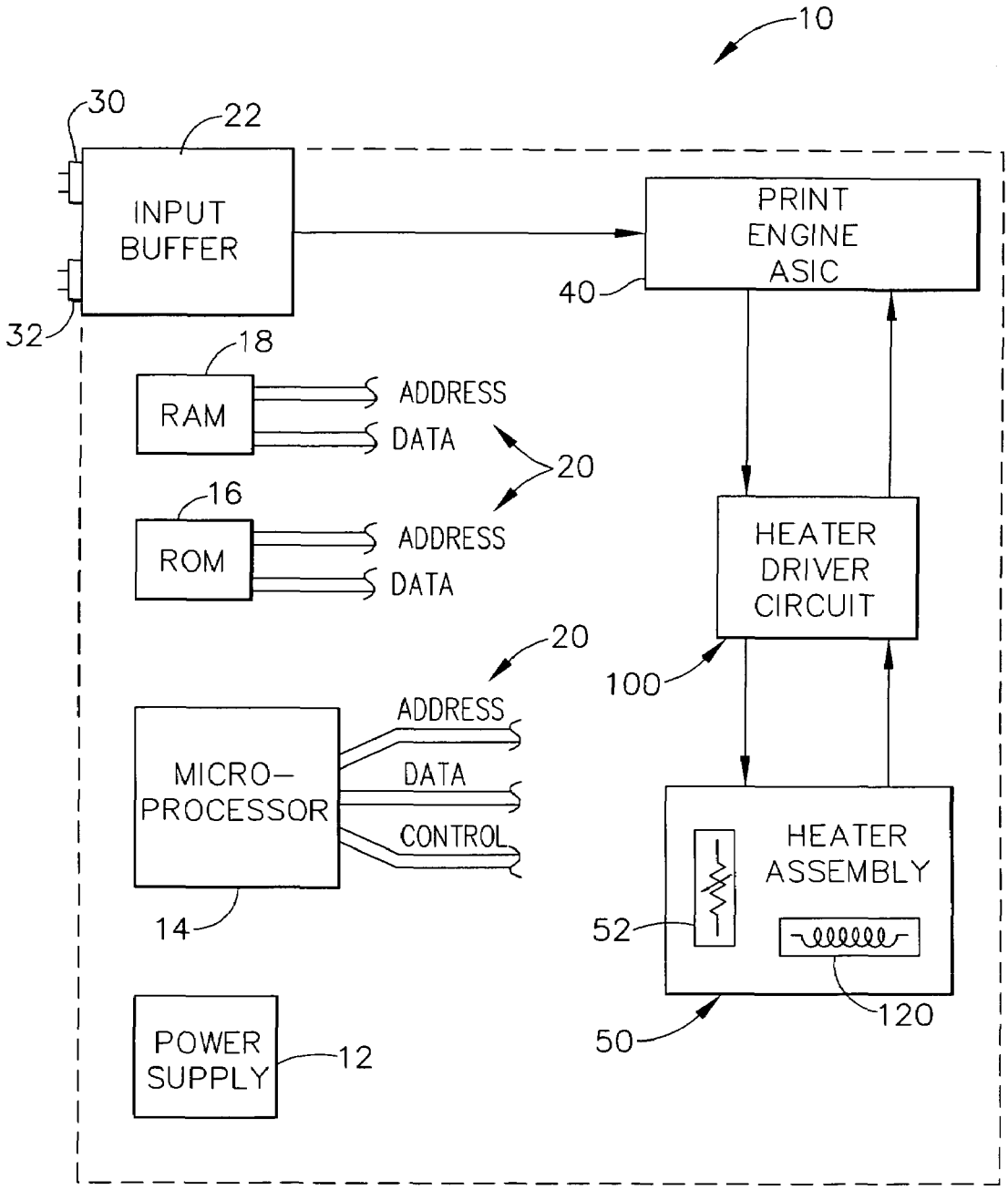
FIG. 1 is a block diagram of some of the hardware components of a laser printer, according to the principles of the present invention.

Reference will now be made in detail to the present preferred embodiment of the invention, an example of which is illustrated in the accompanying drawings, wherein like numerals indicate the same elements throughout the views.

Electrophotographic (EP) printers such as laser printers typically use a fuser apparatus to fix a toner image to some type of print media, such as paper. Belt fusers are popular for laser printers, as noted above, because of their nearly "instant on" characteristic. However, they have a predetermined warm-up time, so they are not truly ready to print in an "instant." In the present invention, the fuser is kept at an initial condition that maintains the fuser's temperature above the ambient machine temperature. Since this temperature is greater than the room temperature, the time required to reach the target (fixing) temperature is less than the time that otherwise would be required for heating from room temperature to the target (fixing) temperature.

Therefore, it is preferred to keep the initial condition of the belt temperature between the ambient temperature of the machine (typically room temperature) and the target (fixing) temperature. However, it is also preferred to use an initial condition that does not require the printer to periodically rotate the drive train to prevent deleterious effects on the drive train components, and for example, does not need to rotate the drive train to prevent rubber compression set in the back-up roller of the fuser; moreover it is preferred for the initial condition to not require a fan to run in the printer to cool the printer.

In the present invention, the initial condition temperature may be chosen so that the time required to raise the fuser temperature from this initial condition temperature to the target (fixing) temperature is equal to or less than the time needed for the rest of the printing system to be ready to print the first page of the print job. In this way, the rest of the printer becomes the limiting factor for time to first print (TTFP), rather than the fuser being the limiting factor. However, it should be noted that the "goal" of having the remainder of the printer become the limiting factor for TTFP is by no means the only useful feature of the present invention. A "smoother" electrical power characteristic, with regard to the printer's effect on other electrical equipment, is another important feature of the present invention, which reduces light flicker, etc. This other characteristic is discussed below in greater detail.

In one exemplary mode of the present invention, the initial condition temperature is selected as 100° C. However, the initial condition temperature could be selected for a higher or lower value than this 110° C. temperature, for other implementations. In a particular laser printer manufactured by Lexmark International, Inc., the 110° C. initial condition temperature provides about a 1.5 to 2.0 seconds of improvement in warm-up time (e.g., from about six (6) seconds to about 4.0–4.5 seconds). Other configurations could be selected to provide a somewhat greater or lesser improvement in the warm-up time, if desired.

In order to maintain the initial condition temperature, a small amount of electrical power is applied to the fuser heating element. In the present invention, the electrical power is provided to the fuser as phase-controlled AC power, which can be used to minimize the amount of light flicker created by the current flow through the heating element of the fuser. In an alternative embodiment, instead of using phase-controlled power, integer half-cycle control can be used, or even ON-OFF control in situations where the instantaneous voltage and current characteristics are less critical. Such control concepts are discussed in greater detail below.

Referring now to the drawings, FIG. 1 is a hardware block diagram generally showing some of the main components of an electrophotographic (EP) printer, generally designated by the reference numeral 10. Printer 10 contains an electrical power supply 12, which typically receives AC voltage and outputs one or more DC voltages. The printer 10 also contains some type of processing circuit, such as a microprocessor or microcontroller 14, which typically has at least one address bus, one data bus, and perhaps one control bus or set of control signal lines, all generally designated by the reference numeral 20.

Such a laser printer 10 would also contain memory elements, such as read only memory (ROM) 16 and random access memory (RAM) 18, which also would typically be in communication with an address bus and data bus, and typically connected through the buses 20 to the microprocessor or microcontroller 14.

Most printers receive print jobs from an external source, and in printer 10 there typically would be an input buffer 22 to receive print data, usually through at least one input port, such as the ports 30 and 32. In modern printers, a typical input port could be a USB port or a network ETHERNET port, but also other types of ports can be used, such as parallel ports and serial ports. The input buffer 22 can be part of the overall system RAM 18, or it can be a separate set of memory elements or data registers, if desired.

The print job data will leave the input buffer 22 and in many modern printers, the data is sent to an application specific integrated circuit (ASIC), generally designated by the reference numeral 40 on FIG. 1. In many printers, there is a separate ASIC for controlling the print raster imaging process and a separate ASIC for controlling the print engine. In many newer printers, the ASICs have become powerful enough that all of the elements that make up the rasterizer (image processor) and the print engine controller can be placed into a single ASIC package. That is the type of arrangement illustrated in FIG. 1. The processing circuit and memory circuit elements may, or may not, be resident on the ASIC.

The print engine portion of the laser printer 10 will control the fuser's electrical interface circuit, and on FIG. 1 this is referred to as the heater driver circuit 100. The heater driver circuit 100 is then in communication with the actual heater assembly (e.g., a "fuser"), which is generally designated by the reference numeral 50 on FIG. 1. The heater assembly 50 includes an electrical heating element 120, as well as a temperature sensor 52. In most laser printers manufactured by Lexmark International, Inc., the temperature sensor is a thermistor.

Figure 2:
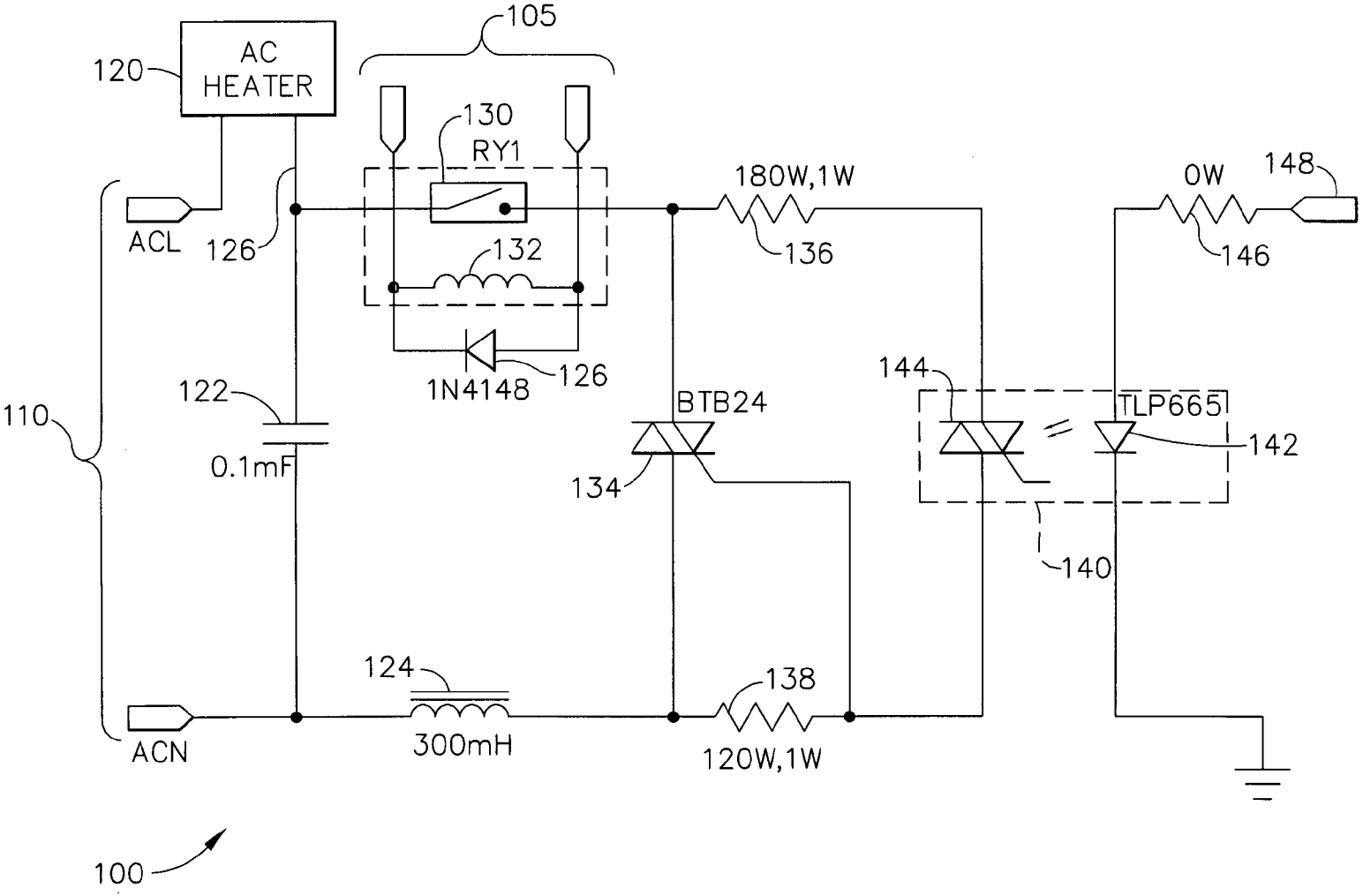
FIG. 2 is an electrical schematic diagram of a fuser or heater driver circuit used in the printer of FIG. 1.

Referring now to FIG. 2, a portion of the heater driver circuit 100 is illustrated in the form of an electrical schematic diagram. AC line voltage is provided at the reference numeral 110, which represents two terminals for AC line (ACL) and AC neutral (ACN). In the United States, this typically would be an AC line voltage in the range of 110–120 volts AC, single phase, at 60 Hz. One side of this AC power is then connected to the "AC heater" 120, which is the actual electrical heating element that provides thermal energy to the fuser assembly 50. The other side of the line voltage is connected to a capacitor 122 and an inductor 124. The capacitor 122 is also connected to the opposite side of the AC heating element 120, at an electrical circuit pathway 126.

In one exemplary mode of the present invention, a "safety relay" is provided to monitor the thermistor temperature, to ensure that the thermistor has not overheated; if it has, the safety relay will open an electrical contact to prevent the AC heating element 120 from being energized any further. This safety relay is generally designated by the symbol "RY1", which includes an electromechanical contact 130, and an inductive coil 132. The coil 132 is energized by a relatively low voltage circuit 105, which will become de-energized if the thermistor reads a temperature that is greater than desired for the printer's operation. In one mode of the present invention, this low-voltage circuit 105 is a twenty-four volt circuit. In FIG. 2, there is a diode 126 that prevents an over-voltage across the coil 132 when it de-energizes.

The current through the AC heater element 120 continues through the contact 130 to a triac 134 (e.g., a part number BTB 24) and a biasing resistor 136, which in turn supplies current through a second triac element 144 that is part of an opto-coupler 140 (e.g., a part number TLP665). The driver side of opto-coupler 140 is an LED 142, which receives a signal at a signal line 148. The signal 148 is a command from the printer's controller, which typically would be a signal that is derived at the ASIC 40. When this signal becomes at a predetermined voltage level (referred to as Logic 1), then a sufficient current will drive through the LED 142 to turn on the triac 144. This will then allow current to flow through the AC heater element 120. Triac 144 is biased or gated by the other triac 134, as well as resistors 136 and 138. A current-limiting resistor 146 can be included, if desired, although in an exemplary mode of the present invention, the resistor 146 is set to zero Ohms, and the current through the LED 142 is controlled by the ASIC 40 on the controller card.

The control signal at 148 will typically be a phase-firing control signal, in one exemplary mode of the present invention. As noted above, the current supplied to the fuser heating element can be in the form of phase-controlled AC power, or it could be in the form of integer half-cycle control, or some other control scheme, if desired. In the most rudimentary form, the control can be simple on-off control, sometimes referred to as "bang-bang" control, since there would be no attempt to control the timing of the on and off transitions with respect to the single phase AC power that enters the circuit at 110.

With regard to integer half-cycle control, one simple way to implement that type of control scheme is to select certain half-cycles of the AC current that are to be supplied to the fuser heating element 120. For example, three (3) consecutive half-cycles of AC power can be selected as being a single overall "control period," and the power levels will be controlled in a fairly coarse manner as either being 0/3 for 0% duty cycle, 1/3 for 33% duty cycle, 2/3 for 66% duty cycle, or 3/3 for 100% duty cycle (which is full power). The control circuit will provide the signal 148 at the appropriate times to turn on the AC power at a zero-crossing point of the sine wave for the line power at 110 on FIG. 2. The signal 148 will also control when the power is to be interrupted, at a later zero-crossing, either after a single half-cycle, after two half-cycles, or after three half-cycles. After this has been accomplished, then the controller will address the next three half-cycles of AC power as being the next "control interval." Of course, if the percent power to be delivered to the fuser is 0%, then for a particular control interval, the signal 148 will not energize the LED 142 at all during those three half-cycles that make up that control interval.

A much finer control can be utilized by using phase-controlled AC power. The signal 148 can be used to turn on the LED 142 at a certain phase angle after a zero crossing of the incoming AC line voltage at 110. This can be controlled in whatever precision is desired, but typically 8-bit precision is quite sufficient, which provides 256 possible duty cycle percentages. In many phase-controlled circuits, the timing of the "start" mark of a particular AC half-cycle is controlled to not be at a zero crossing, but the termination of this half-cycle can be implemented to always occur at such a zero crossing, to reduce the transient voltage and current when the inductive heating element 120 is de-energized. This is not necessary, but it is often desired in many types of equipment.

Finer control can also be implemented strictly using integer half-cycle control, if desired. It will be understood that any number of half-cycles can be chosen to act as the "control period." If four half-cycles are chosen, then the possible power levels are 0%, 25%, 50%, 75%, and 100% (i.e., 0/4, 1/4, 2/4, 3/4, and 4/4 of full power). The "control interval" can be many more half-cycles than three or four, and, for example could be ten (10), in which case the duty cycle would be in intervals of 10%, in the range from 0% through 100% inclusive. The "fuser ON" signal 148 can be controlled to merely select the starting zero-crossing and the ending zero-crossing for each of the control intervals, at times when the fuser is to be energized.

If the printer is beginning to print for the first time after not operating for a fairly long time period, then it may be likely that the duty cycle would be 100% for this fuser ON signal 148, to bring the heater assembly 50 up to temperature as quickly as possible. On the other hand, if a closed loop control system is used, which is an exemplary mode of the present invention, then a controller will typically change the duty cycle to reduce the amount of temperature overshoot as the fuser assembly 50 nears its nominal operating temperature. This will be discussed below in greater detail.

Figure 3:
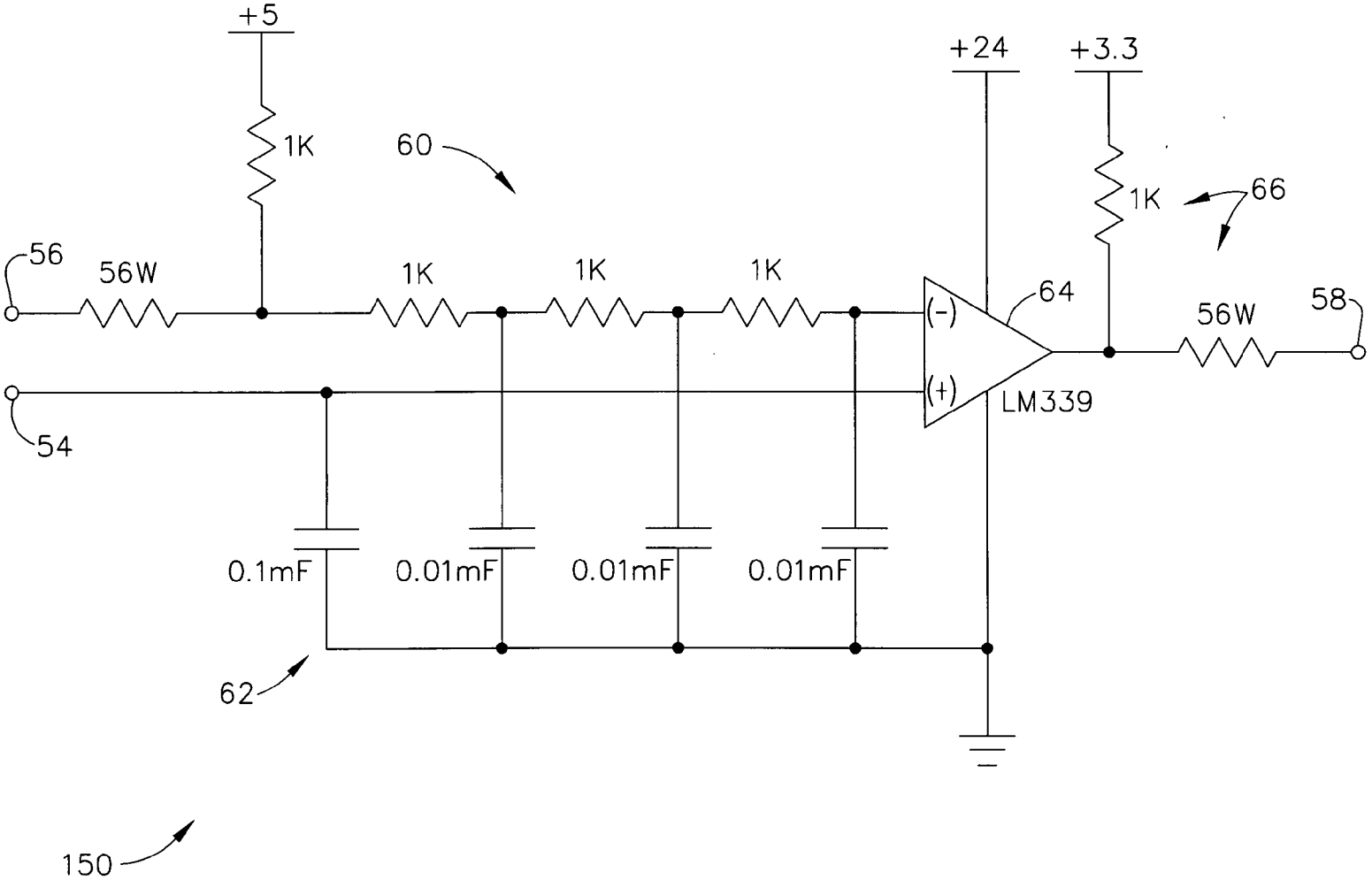
FIG. 3 is an electrical schematic diagram of a low-cost A/D converter used in the printer of FIG. 1.

Referring now to FIG. 3, an electrical schematic diagram of a circuit generally designated by the reference numeral 150 is illustrated. This circuit operates as a low-cost analog-to-digital (A/D) converter circuit to measure the voltage being produced by the thermistor 52. Naturally, a commercial A/D converter could be used, but it would likely be much more expensive. On FIG. 3, a pulse train signal is provided at 56, which would typically be at logic voltage signal levels, such as 0–5 volt DC transitions. This signal 56 is used to set a voltage level that will represent the duty cycle that is desired for the current operating condition of the printer, vis-à-vis its actual fuser temperature compared to its desired fuser temperature. A second signal that is provided at 54 represents the actual fuser temperature, which is a voltage signal derived from the thermistor 52. There are some resistors 60 and capacitors 62 that operate as filters, and these signals drive into the two inputs of a comparator stage of an LM 339 comparator chip 64. The output of this comparator chip 64 is then signal-conditioned by two resistors 66. This output signal is directed to a terminal 58.

The overall operation of this circuit 150 uses the signal 56 to act more or less as a threshold voltage at the negative input terminal of the comparator chip 64, while the other input voltage 54 represents the actual fuser temperature. The output signal 58 will turn on for a particular duty cycle if the actual fuser temperature is below the threshold level indicated by the signal 56. This output signal 58 can be in the form of a DC signal, or in the form of a pulse-width modulated signal that can be used to control a phase-fired AC signal, such as the signal running through the triac 144 and the heating element 120 of FIG. 2. Additional control interface circuitry can be provided, if desired, for implementing the integer half-cycle control, or to implement some other type of control scheme other than a pulse-width modulated signal used in a phase-controlled AC power circuit, without departing from the principles of the present invention.

It should be noted that the control scheme used in the present invention is not limited to strictly a feedback control mode. Alternative control modes could be used, if desired, also without departing from the principles of the present invention. For example, the control system may be envisioned to run in some type of feed-forward control if desired. In a similar way, the control system can be envisioned as running in an open loop mode. An example of open loop control is to turn on the fuser heater for a selected amount of time (for example, 1 second) at a selected power (for example, 1/3 power) any time the fuser temperature falls below a certain threshold (for example, below 110 degrees C.).

If PID control is selected as the control scheme, the PID gains (Kp=proportional gain, Ki=integral gain, and Kd=derivative gain) may be chosen to give the best compromise between temperature swing and speed of response. In one exemplary implementation, the Kp, Ki, and Kd variable values were chosen as 12, 13/32, and 11 respectively for printing mode, and 3, 2/32, and 1 respectively for standby mode. This change of gains gave better performance with respect to light flicker. However, other implementations may be envisioned with only one set of Kp, Ki, and Kd gains for printing and standby, and in a similar way, other implementations may be envisioned with much different numeric values selected for these PID control parameters. See below for further details on implementing the invention using a PID control scheme.

The average power consumption is a function of the "initial condition temperature." The power consumption will decrease when the "initial condition temperature" selected is closer to room ambient temperature; alternatively, the power consumption will increase when the "initial condition temperature" selected is closer to the target (fixing) temperature. In one example printing system, the power supplied to the fuser heater was approximately 15–20 watts to hold the "initial condition temperature" at a value between 100–110 degrees C. A machine total power consumption of approximately 25–30 watts was measured for this example printing system; of course, other implementations are possible while falling within the principles of the present invention.

In an exemplary mode of the present invention, the "initial condition temperature" may be maintained indefinitely. It can be readjusted, if necessary, to meet the ENERGY STAR and Blue Angel requirements, and for example, it may be set to lower and lower levels as time passes, in order to meet those requirements.

Figure 4:
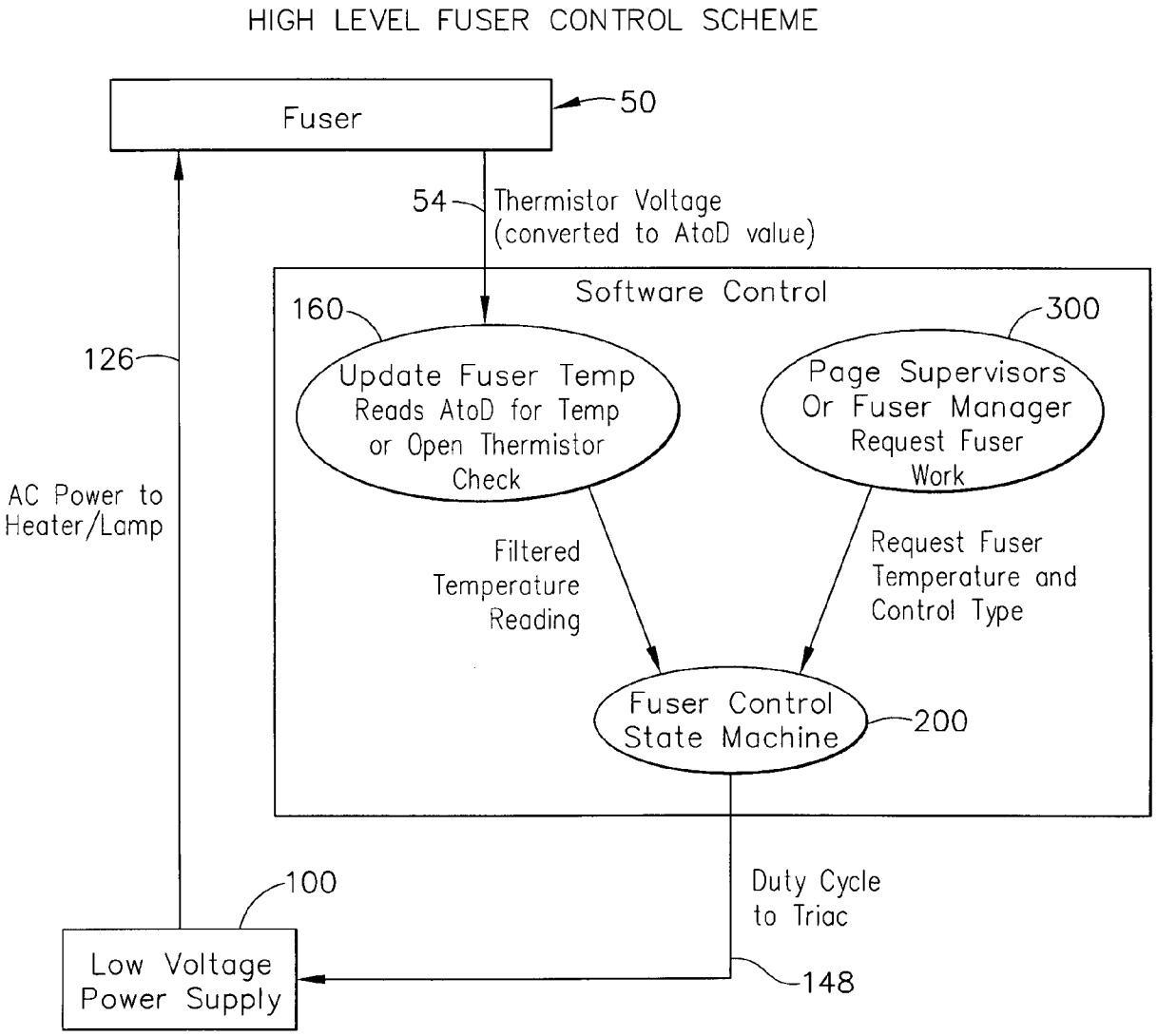
FIG. 4 is a high-level control diagram for the fuser temperature controller used in the printer of FIG. 1.

FIG. 4 is a simplified flow chart showing the fuser control scheme at a high level. The fuser 50 and the low voltage power supply (the heater driver circuit) 100 are illustrated on FIG. 4 as hardware components, and the software control components as major control concepts are also illustrated.

The thermistor voltage signal 54 is output by the fuser assembly 50, and is "read" by a function 160 that updates the fuser temperature. This function includes the circuit 150 that reads the thermistor voltage and converts it (using the low cost A/D converter) to a signal that is used to control the fuser's heating duty cycle. This update function 160 also includes a circuit well known in the art that determines if the thermistor has become an open circuit. If so, then a command will be entered to shut the printer down.

The "filtered" temperature reading is then directed to a fuser control state machine 200. There is also a "page supervisor" function 300, which is also referred to as the "fuser manager" state machine. This function 300 is the calling function that requests operation of the fuser when it is time to print a sheet of print media. Fuser manager 300 not only requests the fuser to operate, but requests a certain fuser temperature and control type. These requests are entered to the fuser control state machine 200. These functions 200 and 300 are described in greater detail below.

The fuser control state machine 200 outputs a duty cycle to the controlling triac at signal 148. This is the "fuser ON" signal that is also seen on FIG. 2. Once the low voltage power supply/heating driver circuit 100 receives this control signal 148, it outputs electrical power at 126 to the fuser heating element.

In one mode of the present invention, the software control elements of FIG. 4 are used to determine the overall belt fuser control modes and temperatures. For example, if the control mode is "standby," then the fuser temperature is maintained at its standby temperature of 110° C., or a different temperature if that different temperature is selected by the printer designer. In a "printing" mode, the fuser is to be running at its normal operating temperature, which for different printers may be an operating temperature somewhere in the range of 180° C. to 220° C. This temperature depends upon the type of fuser and the type of print engine being used in the particular laser printer. If the control mode is "ramping," then the fuser temperature is controlled between the standby temperature and the printing mode temperature, and typically the ramping mode attempts to increase the fuser temperature as quickly as possible, within certain "flicker" prevention requirements, and also within certain control concepts that will try to prevent a significant overshoot of temperature once the target printing fuser temperature is neared.

Figure 5:
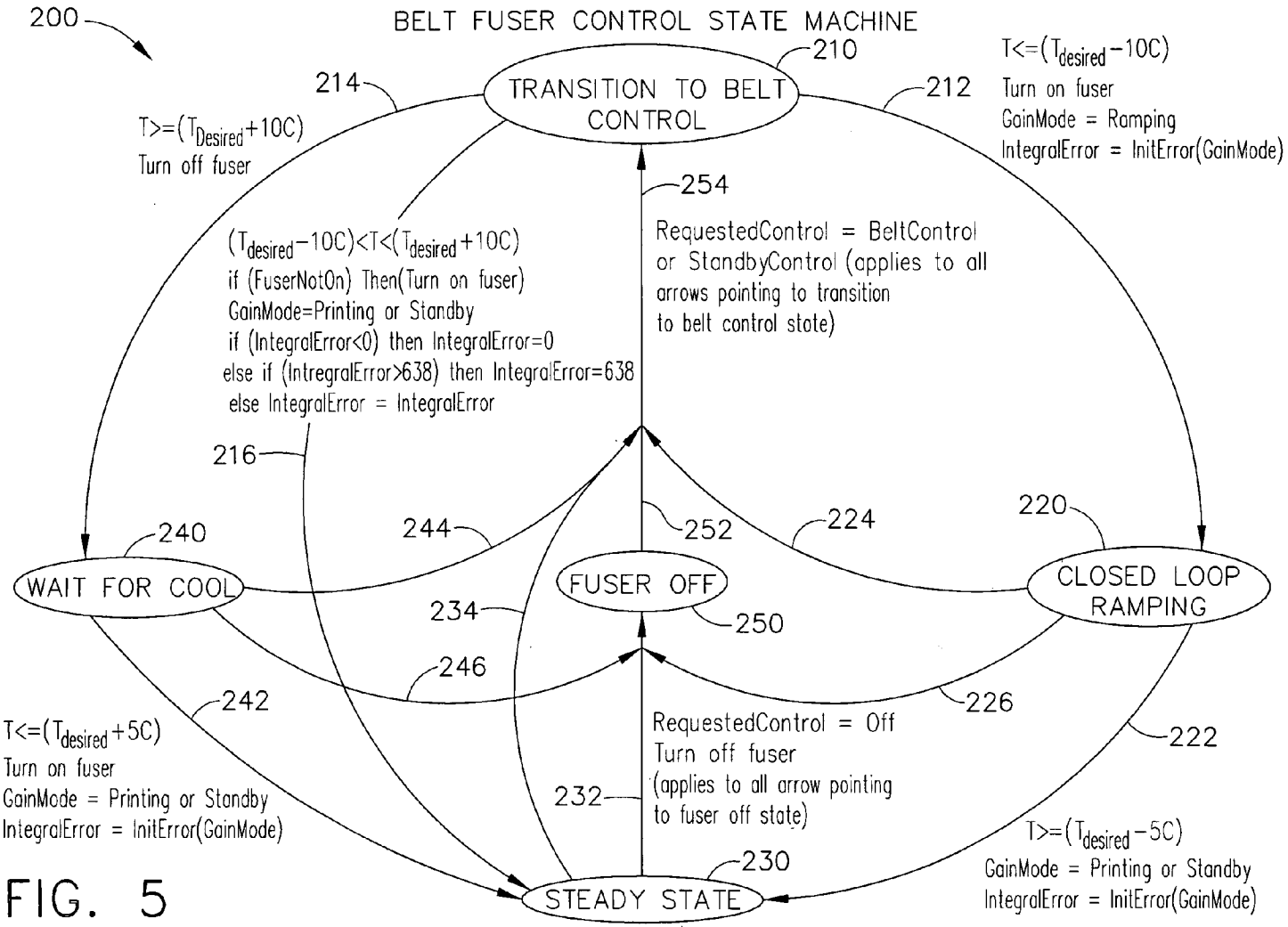
FIG. 5 is a logic state machine diagram for the belt fuser control state machine using the printer of FIG. 1.

Referring now to FIG. 5, a state machine diagram 200 is provided for the belt fuser control algorithm. Starting at a control state 210 that transitions to the fuser belt control, if the actual fuser temperature is greater than or equal to the desired fuser temperature +10° C., then the fuser is to be turned off along a pathway 214. This sends the control logic to the state at 240, that is referred to as the "wait for cool" state. However, if the current fuser temperature is less than or equal to the desired fuser temperature −10° C., then the fuser is to be turned on, using a signal pathway 212 that sends the control to a "closed loop ramping" state at 220. While doing so, the gain mode is set to "ramping," and the integral error value is set to an initial error value for the ramping gain mode function. These gain numeric values are described below in greater detail.

From the closed loop ramping state 220, the logic flow can travel down a pathway 222 if the current fuser temperature is greater than or equal to the desired temperature −5° C. When that occurs, the control state known as "steady state" is entered at 230. During this transition of states, the gain mode is set to either printing or standby, the integral error value is set to the initial error value. Now that the steady state 230 has been achieved, the fuser will be energized under the appropriate duty cycle until it is time to turn the fuser off. The fuser can be turned off at a state 250 from the steady state, via an arrow 232. The fuser off state 250 requests the main controller to set the fuser mode to "OFF," and this request applies to all arrows pointing to the fuser off state 250. When in the steady state 230, the control mode will pass back to the transition to belt control state 210 from the steady state 230, via an arrow 234 if the fuser is not to be turned off at this time.

If at the closed loop ramping state 220, and if a different fuser control or temperature is requested, then the control mode is passed either along arrow 224 or 226, back to the transition to belt control state 210. If arrow 226 is used, the fuser is turned off at state 250. The arrow from the fuser off state to the transition state 210 is the arrow 254, which calls forth the requested control as being either the belt control mode or the standby control mode.

If the control state currently is waiting for the fuser to cool at 240, and if the fuser's current temperature is less than or equal to the desired temperature +5° C., then the fuser is turned on through an arrow 242 to the steady state 230. While this occurs, the gain mode is set to either printing or standby, the integral error mode is set equal to the initial error (in the gain mode function).

When in the wait for cool state 240, if a different fuser control or temperature is requested, then the control mode is passed back to the transition to belt control state 210, either along an arrow 244, or an arrow 246 that first turns the fuser off at the fuser off state 250.

When in the transition state 210, if the fuser temperature is not greater than or equal to the desired temperature +10° C., or if it is not less than or equal to the desired temperature −10° C., then the control state is set directly to the steady state 230, via an arrow 216. In this transition to steady state 230, if the fuser is not already on, then the fuser is to be turned on. The gain mode is set equal to either printing or standby, and if the integral error is greater than zero (0), then the integral error is set to zero (0). On the other hand, if the integral error is greater than 638, then the integral error value is set to 638. Finally, if the integral error is already at any other value than that described above, then the integral error value is not changed.

The numeric values for the variables integral error and initial error, are control concepts used in proportional-integral-derivative mode controllers, also commonly referred to as PID controllers. In an exemplary mode of the present invention, the PID controller is implemented within the print engine code that runs in the print engine ASIC, and uses a processing circuit, either within the ASIC, or perhaps a separate microprocessor or microcontroller device. This is an exemplary mode of the present invention, but as discussed above, other control schemes are envisioned by the present inventors, such as proportional-integral modes only, or proportional mode only, or even "bang bang" ON/OFF mode control, without departing from the principles of the present invention. The PID controller will be discussed in greater detail below.

In an exemplary mode of the present invention, the belt fuser control state machine logic of FIG. 5 is executed periodically to handle fuser control and temperature change requests by the printing system. As can be seen by inspecting FIG. 5 and reading the above explanation, the modes used in this control state machine 200 are "ramping", "steady state", and "standby". Other modes of operation could be used if desired, but these three modes are sufficient to operate the printer temperature controller according to the principles of the present invention.

Figure 6:
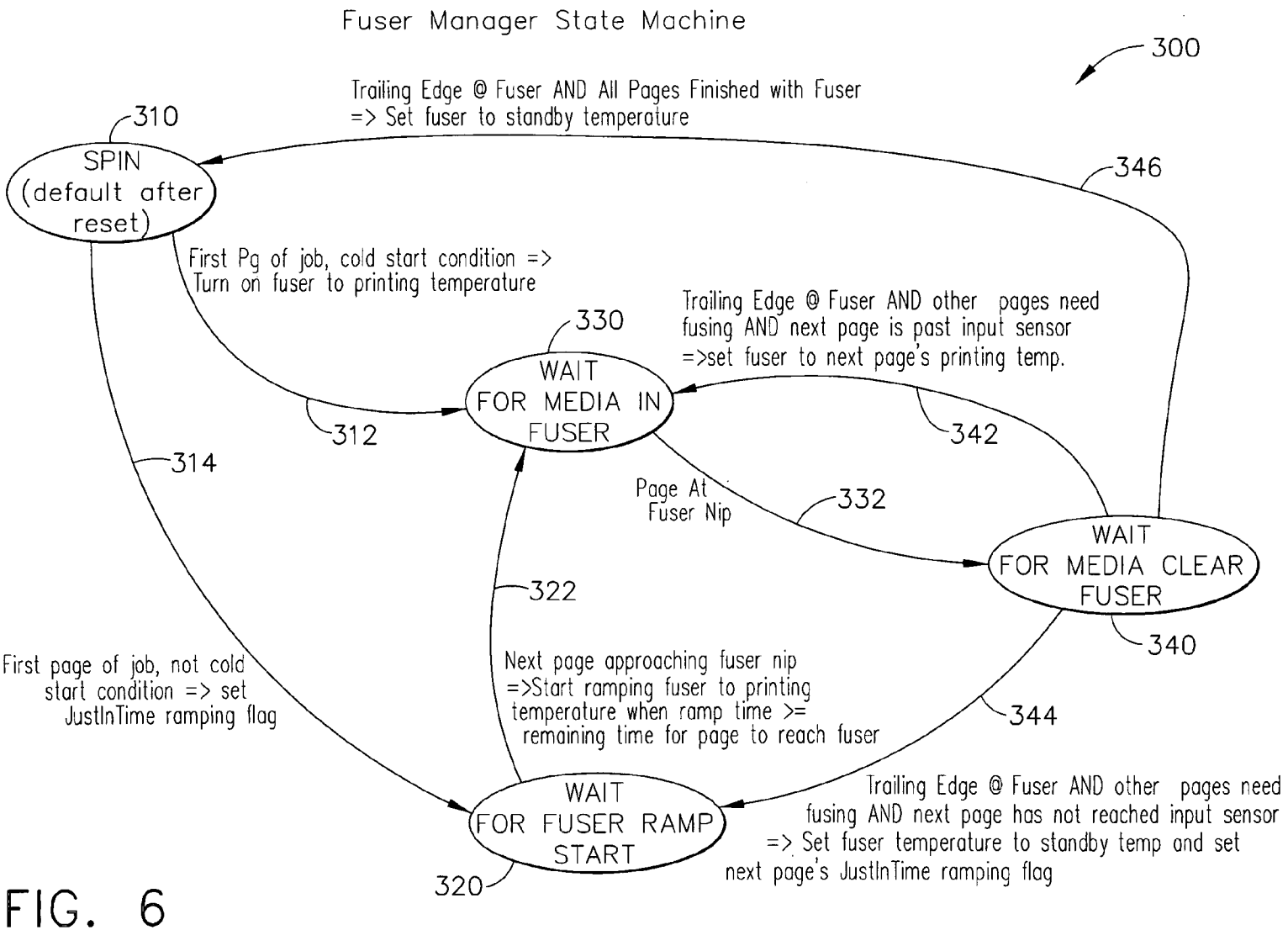
FIG. 6 is a logic state machine diagram of the fuser manager state machine used in the printer of FIG. 1.

Referring now to FIG. 6, a logic state machine diagram 300 is presented for the fuser manager state machine. This is the control logic that requests that the fuser perform work. Beginning at an idle state 310 referred to as "spin," the state machine logic can request one of two different modes at the beginning of a print job for a sheet of print media. One mode is for a "cold start condition," and the other mode is if there is not a cold start condition. The spin state 310 is the default after a reset of the control logic of the printer 10.

If this is a cold start condition, then the logic flow travels down an arrow 312 to a state 330 that is referred to as the "wait for media in fuser" state. The control logic turns on the fuser to the printing temperature during the transition from the spin state 310 to this wait state 330. Once the printer realizes that the first page of the print job has reached the fuser nip, then an arrow 332 transfers the logic control to a state 340 referred to as a "wait for media clear fuser" state, where it remains until the media clears the fuser.

If at the spin state 310, and alternatively the control logic determines that the first page of a print job has not occurred during a cold start condition, then a "just in time ramping" flag is set and the logic flow travels down an arrow 314 to a state 320 that is referred to as the "wait for fuser ramp start" state. Once at state 320, the logic stays here until it is realized that the next page is approaching the fuser nip. When that occurs, the temperature begins ramping so that the fuser temperature is set to the printing temperature when the ramp time is greater than or equal to the remaining time for the page to reach the fuser nip. This occurs along an arrow 322, and that changes the logic state to the wait for media in fuser state 330.

When the printer realizes that the first page of the print job has reached the fuser nip, then the arrow 332 transfers the logic control to the "wait for media clear fuser" state 340, where it remains until the media clears the fuser. Once at state 340, if the trailing edge of the page passes the fuser and other pages need to be printed, and if the next page is past the input sensor, then the fuser is set to the next page's printing temperature along an arrow 342, and the logic is sent back to the wait for media in fuser state 330. In other words, the temperature should stay approximately where it already is at, at least for the same type of sheet media.

On the other hand, at state 340 if another page needs to be printed and the next page has not yet reached the input sensor, then the fuser temperature is set to its standby temperature, and a "just in time ramping" flag is set. This occurs along an arrow 344, and changes the state to the wait for fuser ramp start state 320. Finally, at state 340 if the trailing edge of the media has passed through the fuser and all pages are finished for this print job, then the logic travels along an arrow 346 to the spin state 310, and the fuser is set to its standby temperature.

Figure 7:
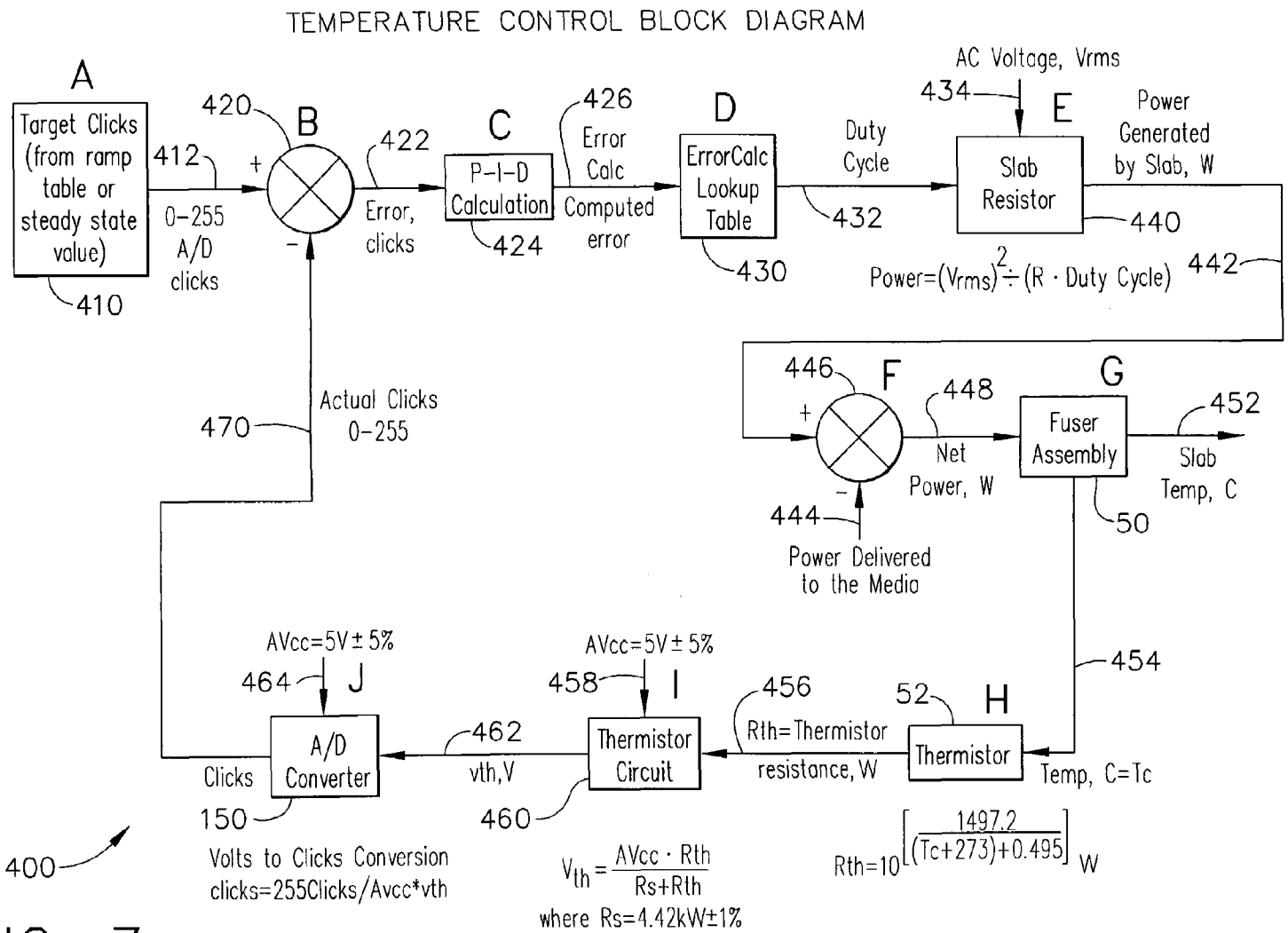
FIG. 7 is a temperature control block diagram used for a first embodiment temperature controller, for controlling the temperature of the fuser, as used in the printer of FIG. 1.

Referring now to FIG. 7, a logic block diagram is provided generally designated by the reference numeral 400, which represents a first embodiment of a temperature control algorithm usable with the fuser of the present invention. Starting at a block 410, the number of target "clicks" is received from a ramp table, or is a steady state value received from the controller. The term "clicks" refers to a numeric value, typically in the range of zero (0) through 255, for a control system having an 8-bit precision. The number of clicks would be zero (0) for a minimum value and 255 for a maximum value, representing the numeric integer values using this 8-bit precision. If this was translated into voltage levels, the zero (0) level could be represented by zero (0) volts DC, and the numeric click value 255 could be represented by +5 volts DC, for example.

The target clicks in the temperature control block diagram 400 represent the desired temperature that the fuser assembly 50 is to be set to. This numeric value is directed down an arrow 412 to a difference function 420, in which the actual temperature of the fuser (also in units of "clicks"—a different numeric value in the range of 0–255) is subtracted from the target temperature (in clicks), resulting in a difference value, which is referred to as the "error" (also in units of clicks), at an arrow 422. This difference function 420 is a standard function used by many PID controllers. Using the error value 422, a PID calculation occurs at a calculation block 424, and the computed error result is directed down an arrow 426 to an error calculation lookup table 430. (Some type of transfer function could be used instead of a lookup table, as is understood in the art.)

The result of this lookup table is a duty cycle value, which is directed down an arrow 432 to a power calculation at a block 440. The heating element of the fuser is sometimes referred to as a "slab resistor," and its resistance value is typically in the range of 7.2 Ohms through 43 Ohms. The AC voltage in RMS volts is designated by an arrow 434. The power output from the calculation block 440 is equal to the RMS voltage squared divided by the resistance value of the heating element, times the duty cycle of the signal 432. This output power in watts is a result, and is directed down an arrow 442 to another difference calculation at 446.

If a sheet of print media is passing through the fuser at this time, then some of the fuser's power will be delivered to that media as the toner is fixed to that media. The power delivered to the media is represented by an arrow 444, and this is subtracted from the power generated by the slab resistor, represented by the arrow 442. The difference is the net power being delivered to the fuser assembly, represented by an arrow 448. The fuser assembly 50 receives this power, and the controller calculates the resulting desired slab temperature in degrees C, at an arrow 452.

The fuser temperature is also directed down an arrow 454 to a mathematic model of the thermistor 52. A calculation that determines the expected resistance value of the thermistor for a given temperature is provided on FIG. 7, and converts the temperature of the thermistor into resistance units of Ohms. This resistance value is then passed along an arrow 456 to a thermistor circuit block 460. This block receives a power supply voltage of 5 volts ±5% at 458, and calculates a desired thermistor circuit output voltage using the calculation illustrated on FIG. 7. This voltage calculation is directed along an arrow 462 to an A/D converter, such as the A/D converter 150. Another power supply voltage of 5 volts ±5% is received along an arrow 464, and the thermistor voltage 462 is then converted into clicks, which is directed along an arrow 470 back to the difference block 420. This signal 470 represents the actual thermistor temperature in clicks, and it is used in the calculation of the current "error" as compared to the desired temperature that is derived along the arrow 412.

Figure 8:
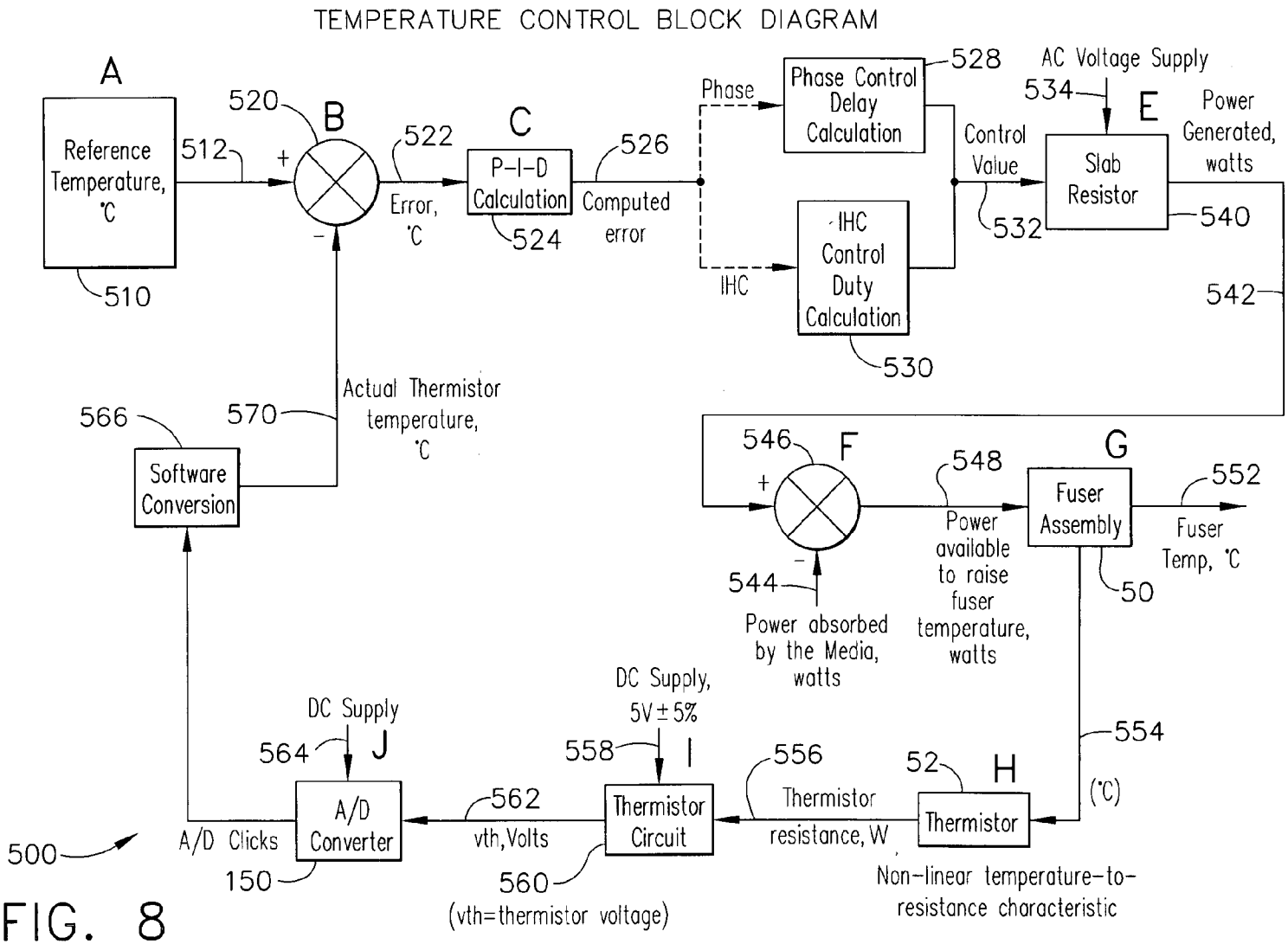
FIG. 8 is a temperature control block diagram used for a second embodiment temperature controller, for controlling the temperature of the fuser, as used in the printer of FIG. 1.

Referring now to FIG. 8, a logic block diagram is provided generally designated by the reference numeral 500, which represents a second embodiment of a temperature control algorithm usable with the fuser of the present invention. Starting at a block 510, a reference temperature (in degrees C.) is received from the control system, which could be a steady state value received from the controller. This reference temperature represents the desired temperature that the fuser assembly 50 is to be set to, and will likely change its numeric value when the printer changes operating modes (e.g., from standby mode to printing mode).

The reference temperature 510 is directed down an arrow 512 to a difference function 520, in which the actual temperature of the fuser 570 (in degrees C.) is subtracted from the target temperature, resulting in a difference value, which is referred to as the "error" (also in units of degrees C.), at an arrow 522. This difference function 520 is a standard function used by many PID controllers. Using the error value 522, a PID calculation occurs at a calculation block or step 524, and the computed error result is directed down an arrow 526 to a function that will use this computed error.

As discussed above, the present invention can be used with more than one type of output circuit control mode, including a "phase control delay" mode and an "integer half-cycle" (IHC) mode. In FIG. 8, these two output control modes are both represented as selectable functions by the processing software of the overall temperature control system. If phase control is selected, then the computed error 526 is directed to a block 528, in which an output control value 532 will essentially comprise a phase-firing voltage waveform or signal which exhibits a duty cycle that is appropriate for the computed error signal 526.

If IHC control is selected, then the computed error 526 is directed to a block 530 in which the output control value 532 will essentially comprise an integer value of AC sine wave half-cycles as a voltage waveform or signal which exhibits a "longer" interval "total duty cycle" that is appropriate for the computed error signal 526. (In IHC control, the duty cycle for a given half-cycle will either be 100% or 0%, but the "overall" or "total" duty cycle for a predetermined number of half-cycles will be at some fraction between 0% and 100%, inclusive, as discussed above.) The numeric values to be used in these calculations for function blocks 528 and 530 could be stored as an error calculation lookup table, or provided by use of some type of transfer function.

The control value 532 is directed down an arrow 532 to a "slab resistor" power calculation at a function block 540. (As noted above, the heating element of the fuser is sometimes referred to as a "slab resistor.") The AC voltage supply in RMS volts is designated by an arrow 534. The power generated by slab resistor in calculation block 540 is equal to the RMS voltage squared divided by the resistance value of the heating element, times the duty cycle of the signal 532. This output power in watts is a result, and is directed down an arrow 542 to another difference calculation at 546.

If a sheet of print media is passing through the fuser at this time, then some of the fuser's power will be delivered to (or absorbed by) that media as the toner is fixed to that media. The power absorbed by the media is represented by an arrow 544, and this is subtracted from the power generated by the slab resistor, represented by the arrow 542. The difference is the net power being delivered to the fuser assembly which is available to raise the fuser temperature, represented by an arrow 548. The fuser assembly 50 receives this power, and the controller calculates the resulting desired slab temperature in degrees C., at an arrow 552.

The fuser temperature (in C) is also directed down an arrow 554 to a mathematic model of the thermistor 52 which, as a thermistor, exhibits a non-linear temperature-to-resistance characteristic. The thermistor's resistance (in units of Ohms) is passed along an arrow 556 to a thermistor circuit block 560. This circuit block receives a DC power supply voltage of 5 volts ±5% at 558, and converts the thermistor's resistance in Ohms into an output voltage, which is directed along an arrow 562 to an A/D converter, such as the A/D converter 150.

The A/D converter 150 receives a DC power supply voltage of 5 volts ±5% along an arrow 564, and the thermistor voltage 562 is then converted into clicks. (As noted above, the term "clicks" refers to a numeric value, typically in the range of zero (0) through 255 for a control system having an 8-bit precision, for example. The number of clicks could be zero (0) for a minimum value and 255 for a maximum value, representing the numeric integer values using this 8-bit precision.) A software function at a block or step 566 then converts this numeric value in clicks to a temperature value in degrees C., which is output from block 566 along an arrow 570. This arrow 570 represents the present actual temperature of the fuser (or more specifically, the fuser's thermistor 52), and this value is fed back to the difference function 520, and then used in the calculation of the current "error," along with the desired temperature 512.

One benefit of using a PID control scheme for controlling the temperature of the fuser is that some of the electrical power requirements can be reduced, particularly for transient "turn-on" voltage and current characteristics. For example, if simple ON-OFF control is used for a "large" laser printer (e.g., for a heavy-duty office color laser printer) that includes a rather powerful fuser, then the operating characteristics of the printer using ON-OFF control may not be optimal, because there can be significant inrush current that may cause light flicker in other electrical equipment on the same branch line circuit. In one "large" printer, the fuser draws current on the order of 9–11 Amperes for a 120 VAC printer when full on. A "bang-bang" ON-OFF control may well result in light flicker at this magnitude of abrupt current switching.

The more refined output signal control available in some control modes (e.g., phase control or IHC control) of the present invention can indeed reduce the power transients induced in other electrical equipment that is nearby to the printer 10, to an extent that the light flicker of that other equipment becomes virtually undetectable to the human eye. This is true for electrical equipment running on 120 VAC power lines and for that running on 230 VAC power lines. Thus, in the United States, the EPA's ENERGY STAR power consumption standards can be met (e.g., at 120 VAC); in Europe, the European flicker and harmonic requirements (IEC 61000-3-2 and 61000-3-3) can be met (e.g., at 230 VAC).

On the other hand, if the rather "coarse" control afforded by ON-OFF output signal control is used, it may result in fairly large temperature swings in some of the operating modes, due, for example, to lag time between the resistor heating element (e.g., positioned on one side of the slab element) and the thermistor (which may be positioned on the opposite side of the slab element). In one prototypical test of this configuration, the lag time was on the order of 200 ms, such that when the resistor heating element was energized with electrical current, it took about 200 ms before the thermistor was able to detect a change in temperature. This effect could perhaps be minimized by altering the physical layout of the circuit components, but another way to improve this characteristic is to use a different control mode, such as a PID controller, for example. The PID controller allows a more continuous (and perhaps "finer") energy flow to the fuser load. For example, the use of a PID controller with integer half-cycle control should work well for printers using 50 Hz electrical power in Europe and Japan; the use of a PID controller with phase control should work well for printers using 60 Hz electrical power in the United States.

In many conventional PID controllers, it is normal practice to set the PID control parameters to values that provide optimum performance for the operating extremes of the system being controlled. For a laser printer having a belt fuser, for example, selecting certain values for some of the control parameters (e.g., for "P gain", "I gain", and "D gain") may work well in one mode of operation, such as the ramping mode, but may not work so well in a different mode, such as the warm-up (standby) mode. In other words, the standby mode. may exhibit substantial temperature swings using the same control parameters that would work very well in the ramping mode (or perhaps also in the printing, full-power mode).

With this in mind, another improvement provided by the present invention is the use of more than a single set of PID control parameters—the Kp, Ki, and Kd gains—for different modes of operation. As noted above, different Kp, Ki, and Kd variable values may be used for the printing and standby modes. In a similar manner, a different set of Kp, Ki, and Kd variable values also can be used for the ramping mode.

In one embodiment of the invention, the operating computer software code utilizes a lookup table to decide which PID control parameters should be used during the present stage of the printer's operation. (Note that a transfer function, or some other method for calculating and storing numeric values, could be used instead of a lookup table.) A reasonable set of gains was found to include six possible modes, but there can be more or fewer than six modes for various types of printers when using the present invention. Using this embodiment of the present invention, the six modes are:

(1) Integer half cycle, standby.
(2) Integer half cycle, ramping.
(3) Integer half cycle, printing.
(4) Phase control, standby.
(5) Phase control, ramping.
(6) Phase control, printing.

The PID control variables can be set to many different values by the system designer. A set of tables is presented below showing some example values that are appropriate for certain laser printers manufactured by Lexmark International, Inc. The variable Kp represents the proportional gain factor, the variable Ki represents the integral variable factor, and the variable Kd represents the differential variable factor for the PID controller. In the tabular data below, the integral value is listed as both a numerator value and a denominator value, as well as a denominator shift value.

Within each control mode of these tables, a 5-tuple describes the gain specifics. For example, in the "integer half cycle, standby" case, the 5-tuple of gains is set as (Kp, Ki num/Ki den, Kd, and InitialIntegralError)=(P, I, D, initial error)=(8, 9/16, 20, 5). In this particular example, the proportional gain is "8", the derivative gain is "20", and the integral gain is 9/16, in which the values "9" and "16" are stored as separate values. Note that the variable "InitialIntegralError" may typically be set to a value of zero as it is loaded into the software code. However, this value can be modified and later stored as a non-zero updated value for later generations of a specific printer product, since such a non-zero value might work better in certain printers.

One advantage of the above type of lookup table methodology is that integral gains of less than one (1) can be achieved, which may provide better temperature control, particularly in the standby mode of operation. As can be seen from inspecting the tables below, one optimum integral gain for standby mode was 9/16 using integer half-cycle control. In this manner, integer values can be used in the lookup table for gain factors less than one, rather than floating point numbers. However, if desired by the system designer, floating point numbers could be stored in a lookup table and used for some or all of the PID control parameters.

The example numeric values for these control variables are listed in two different types of control mode. The "phase control" mode values are listed along the right portion of the table, while the "integer half-cycle" mode values are listed on the left side of the table. It will be understood that different numeric values can be used for these PID control variables, without departing from the principles of the present invention. The above values are provided as examples of an exemplary mode of the present invention.

Belt Fuser PID Control Variables
(by hardware control type and printing/standby status)

| | IHC | Phase control |
|---|---|---|
| Kp | | |
| Standby | 8 | 3 |
| Ramping | 36 | 13 |
| Printing | 36 | 13 |
| Ki numerator | | |
| Standby | 9 | 1 |
| Ramping | 3 | 3 |
| Printing | 3 | 5 |
| Ki denominator | | |
| Standby | 16 | 16 |
| Ramping | 16 | 16 |
| Printing | 16 | 32 |
| Ki denominator shift | | |
| Standby | 4 | 4 |
| Ramping | 4 | 4 |
| Printing | 4 | 5 |
| Kd | | |
| Standby | 20 | 1 |
| Ramping | 62 | 1 |
| Printing | 104 | 1 |
| Initial Integral Error | | |
| Standby | 5 | 5 |
| Ramping | 512 | 512 |
| Printing | 383 | 330 |
| Num_FuserGain_Modes | | 3 |
| Num_FuserControl_Types | | 2 |

In the above tabular information, the Ki denominator typically has a numeric value that is a power of 2.

It will be understood that the term "print media" herein refers to a sheet or roll of material that has toner or some other "printable" material applied thereto by a print engine, such as that found in a laser printer, or other type of electrophotographic printer. Alternatively, the print media represents a sheet or roll of material that has ink or some other "printable" material applied thereto by a print engine or printhead, such as that found in an ink jet printer, or which is applied by another type of printing apparatus that projects a solid or liquified substance of one or more colors from nozzles or the like onto the sheet or roll of material. Print media is sometimes referred to as "print medium," and both terms have the same meaning with regard to the present invention, although the term print media is typically used in this patent document. Print media can represent a sheet or roll of plain paper, bond paper, transparent film (often used to make overhead slides, for example), or any other type of printable sheet or roll material. In the present invention, the print media is typically in the form of sheets or "pages," for documents being output by the printer.

It will also be understood that the logical operations described in relation to the logic diagrams of FIGS. 5–8 can be implemented using sequential logic, such as by using microprocessor technology, or using a logic state machine, or perhaps by discrete logic; it even could be implemented using parallel processors. One exemplary embodiment may use a microprocessor or microcontroller (e.g., microprocessor 14) to execute software instructions that are stored in memory cells within an ASIC (e.g., ASIC 40). In fact, the entire microprocessor 14 along with dynamic RAM and executable ROM may be contained within a single ASIC, in an exemplary mode of the present invention. Of course, other types of circuitry could be used to implement these logical operations depicted in the drawings without departing from the principles of the present invention.

It will be further understood that the precise logical operations depicted in the logic diagrams of FIGS. 5–8, and discussed above, could be somewhat modified to perform similar, although not exact, functions without departing from the principles of the present invention. The exact nature of some of the decision steps and other commands in these logic diagrams are directed toward specific future models of printer systems (those involving Lexmark laser printers, for example) and certainly similar, but somewhat different, steps would be taken for use with other types or brands of printing systems in many instances, with the overall inventive results being the same.

It will also be understood that some of the principles of the present invention are applicable to other types of heating devices besides belt fusers. For example, the use of different PID control parameters for various modes of operation can be readily applied to roller-type fusers in EP printers, or in other types of printers that require various components to be quickly heated by use of electrical energy.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A method for controlling a temperature of a printing material fixing apparatus in an image forming apparatus, said method comprising:

(a) providing an image forming apparatus having a memory circuit for storage of data, a print engine, and a processing circuit, said print engine including a belt fuser and a heater driver circuit, and said print engine including a supply of printing material to be applied to print media;

(b) under the control of said processing circuit, energizing said belt fuser with electrical power from said heater driver circuit in a standby mode, to raise a temperature of the belt fuser to a first temperature that is greater than an ambient temperature of said image forming apparatus; and (c) upon receiving a print job, and under the control of said processing circuit, energizing said belt fuser with electrical power from said heater driver circuit in one of a ramping mode and a printing mode, to quickly raise a temperature of the belt fuser to a second temperature that allows said belt fuser to fix said printer material to said print media, such that a time to first print parameter is reduced as compared to raising said belt fuser temperature from an ambient temperature to said second temperature.

2. The method as recited in claim 1, wherein said first temperature exhibits a range of about 80–150 degrees C., and said second temperature exhibits a range of about 160–230 degrees C.

3. The method as recited in claim 1, wherein said heater driver circuit provides electrical power in the form of at least one of: (a) AC waveform phase-control; (b) integer half cycle control; and (c) on-off control.

4. The method as recited in claim 3, further comprising the step of minimizing light flicker when supplying electrical power provided by said heater driver circuit.

5. The method as recited in claim 4, wherein the step of minimizing light flicker has an effect of making variations of light produced by other equipment virtually undetectable, when said image forming apparatus uses a nominal 120 VAC supply voltage.

6. The method as recited in claim 4, wherein the step of minimizing light flicker has an effect of meeting the European flicker requirement IEG 61000-3-2, when said image forming apparatus uses a nominal 230 VAC supply voltage.

7. The method as recited in claim 3, wherein: (a) the electrical power provided by said heater driver circuit exhibits precision greater than or equal to 2-bits when used with said AC waveform phase-control; or (b) the electrical power provided by said heater driver circuit uses control time periods of at least two half-cycles when used with said integer half cycle control; or (c) both.

8. The method as recited in claim 1, wherein said first temperature of the belt fuser is sufficiently low such that, when operating in said standby mode, (a) said print engine does not need to periodically move drive train components to prevent deleterious effects of those components due to temperature rise, and (b) no fan is needed to cool said image forming apparatus.

9. The method as recited in claim 1, wherein said first temperature of the belt fuser is sufficiently high such that, when changing from said standby mode to one of said ramping mode and said printing mode, a time interval required to raise the belt finer from said first temperature to said second temperature is not the limiting factor of said time to first print parameter of the image forming apparatus.

10. The method as recited in claim 1, wherein said processing circuit uses one of the following control modes: (a) closed loop feedback control, (b) closed loop feedforward control and (c) open loop control.

11. The method as recited in claim 1, wherein said processing circuit acts as a proportional-integral-derivative controller when controlling the electrical power from said heater driver circuit, for energizing said belt finer.

12. The method as recited in claim 1, wherein said printing material comprises toner.

13. An image forming apparatus, comprising:

a memory circuit for storage of data; a processing circuit; a print engine that produces a physical output upon a print media, said print engine including a belt fuser and a heater driver circuit and said print engine including a supply of printing material to be applied to said print media;

wherein said processing circuit is configured: (a) to energize said belt fuser with electrical power from said heater driver circuit in a standby mode, and thereby raise a temperature of the belt fuser to a first temperature that is greater than an ambient temperature of said image forming apparatus; and (b) upon receiving a print job, to energize said belt fuser wit electrical power from said heater driver circuit in one of a ramping mode and a printing mode, and quickly raise a temperature of the belt finer to a second temperature that allows said belt finer to fix said printer material to said print media, such that a time to first print operating characteristic is reduced as compared to raising said belt fuser temperature from an ambient temperature to said second temperature.

14. The image forming apparatus as recited in claim 13, wherein said first temperature exhibits a range of about 80–150 degrees C., and said second temperature exhibits a range of about 160–230 degrees C.

15. The image forming apparatus as recited in claim 13, wherein said heater driver circuit provides electrical power in the form of at least one of: (a) AC waveform phase-control; (b) integer half cycle control; and (c) on-off control.

16. The image forming apparatus as recited in claim 15, wherein the electrical power provided by said heater driver circuit tends to minimize light flicker.

17. The image forming apparatus as recited in claim 16, wherein the function of minimizing light flicker has an effect of making variations of light produced by other equipment virtually undetectable, when said image forming apparatus uses a nominal 120 VAC supply voltage.

18. The image forming apparatus as recited in claim 16, wherein the function of minimizing light flicker has an effect of meeting the European flicker requirement IEG 61000-3-2, when said image forming apparatus uses a nominal 230 VAC supply voltage.

19. The image forming apparatus as recited in claim 15, wherein: (a) the electrical power provided by said heater driver circuit exhibits 8- bit precision greater than or equal to 2-bits when used with said AC waveform phase-control; or (b) the electrical power provided by said heater driver circuit uses control time periods of at least two half-cycles when used with said integer half cycle control; or (c) both.

20. The image forming apparatus as recited in claim 13, wherein said first temperature of the belt fuser is sufficiently low such that, when operating in said standby mode, (a) said print engine does not need to periodically move drive train components to prevent deleterious effects of those components due to temperature rise, and (b) no fan is needed to cool said image forming apparatus.

21. The image forming apparatus as recited in claim 13, wherein said first temperature of the belt finer is sufficiently high such that, when changing from said standby made to one of said ramping mode and said printing mode, a time interval required to raise the belt fuser from said first temperature to said second temperature is not the limiting factor of said time to first print parameter of the image forming apparatus.

22. The image forming apparatus as recited in claim 13, wherein said processing circuit uses one of the following control modes: (a) closed loop feedback control, (b) closed loop feed-forward control, and (c) open loop control.

23. The image forming apparatus as recited in claim 13, wherein said processing circuit acts as a proportional-integral-derivative controller when controlling the electrical power from said heater driver circuit, for energizing said belt Laser.

24. The image fanning apparatus as recited in claim 13, wherein said printing material comprises toner.

25. A method for controlling a temperature of a printing material fixing apparatus in an image forming apparatus, said method comprising:

(a) providing an image forming apparatus having a memory circuit for storage of data, a print engine, and a processing circuit, said print engine including a heater device and a heater driver circuit, and said print engine including a supply of printing material to be applied to print media;

(b) under the control of said processing circuit, energizing said heater device with electrical power from said heater driver circuit in at least one of(i) a standby mode, (ii) a ramping mode, and (iii) a printing mode;

(c) said processing circuit being configured to act as a proportional-integral-derivative (ND) controller for energizing said heater device, wherein said PID) controller exhibits at least one predetermined PID) control parameter when acting in a first of said standby, ramping, and printing modes, and wherein said PID) controller varies said at least one of the predetermined PID) control parameters when acting in a second of said standby, ramping, and printing modes.

26. The method as recited in claim 25, wherein said standby mode raises a temperature of the heater device to a first temperature that is greater than an ambient temperature of said image forming apparatus.

27. The method as recited in claim 25, further comprising the step of: upon receiving a print job, and under the control of said processing circuit, energizing said heater device with electrical power from said heater driver circuit in said ramping mode, to quickly raise a temperature of the heater device to a second temperature that allows said heater device to fix said printer material to said print media, such tat a time to first print parameter is reduced as compared to raising said beater device temperature from an ambient temperature to said second temperature.

28. The method as recited in claim 25, wherein said heater driver circuit provides electrical power in the form of at least one of: (a) AC waveform phase-control; (b) integer half cycle control; and (c) on-off control.

29. The method as recited in claim 28, further comprising the step of minimizing light flicker when supplying electrical power provided by said heater driver circuit.

30. The method as recited in claim 29, wherein the step of minimizing light flicker has an effect of making variations of light produced by other equipment virtually undetectable, when said image forming apparatus uses a nominal 120 VAC supply voltage.

31. The method as recited in claim 29, wherein the step of minimizing light flicker has an effect of meeting the European flicker requirement IEC 61000-3-2, when said image forming apparatus uses a nominal 230 VAC supply voltage.

32. The meted as recited in claim 29, wherein: (a) the electrical power provided by said heater driver circuit exhibits precision greater than or equal to 2-bits when used with said AC waveform phase-control; or (b) the electrical power provided by said heater driver circuit uses control time periods of at least two half-cycles when used with said integer half cycle control; or (c) both.

33. The method as recited in claim 25, wherein said processing circuit uses one of the following control modes: (a) closed loop feedback control, (b) closed loop feed-forward control, and (c) open loop control.

34. The method as recited in claim 25, wherein said printing material comprises toner, and said heater device comprises a fuser.

35. The method as recited in claim 25, wherein said at least one predetermined PID) control parameter is stored in said memory circuit in tabular format as integer values, including at least two values for proportional gain, integral gain, and derivative gain.

36. The method as recited in claim 35, wherein said at least one predetermined PID) control parameter is stored in said memory circuit, including a different value per control parameter, for at least two different operating modes.

37. The method as recited in claim 36, wherein said at least one predetermined PID) control parameter is stored in said memory circuit as a 5-tuple, per operating mode.

38. The method as recited in claim 36, wherein said at least two different operating modes includes at least two of: (a) integer half-cycle, standby; (b) integer half-cycle, ramping; (c) integer half-cycle, printing; (d) phase control, standby; (e) phase control, ramping; and (f) phase control, printing.

39. The meted as recited in claim 25, wherein said at least one predetermined PID) control parameter is stored in said memory circuit in tabular format as floating point values, including at least two values for proportional gain, integral gain, and derivative gain.

40. The method as recited in claim 25, wherein said at least one predetermined PID) control parameter is calculated by said processing circuit using a transfer function, including at least two valves for proportional gain, integral gain, and derivative gain.

* * * * *